US009073368B2

(12) United States Patent
Toya

(10) Patent No.: US 9,073,368 B2
(45) Date of Patent: Jul. 7, 2015

(54) LIQUID DISCHARGING APPARATUS

(71) Applicant: SEIKO EPSON CORPORATION, Tokyo (JP)

(72) Inventor: Akihiro Toya, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/222,460

(22) Filed: Mar. 21, 2014

(65) Prior Publication Data

US 2014/0292878 A1 Oct. 2, 2014

(30) Foreign Application Priority Data

Mar. 27, 2013 (JP) ..... 2013-065801

(51) Int. Cl.
*B41J 29/393* (2006.01)
*B41J 15/04* (2006.01)
*B41J 11/00* (2006.01)

(52) U.S. Cl.
CPC ..... *B41J 15/046* (2013.01); *B41J 11/002* (2013.01)

(58) Field of Classification Search
CPC .... B41J 11/008; B41J 11/0095; B41J 25/308; B41J 2/07; B41J 2/04505
USPC ..... 347/19
See application file for complete search history.

(56) References Cited

U.S. PATENT DOCUMENTS 5,453,777 A * 9/1995 Pensavecchia et al. ..... 347/234
7,510,256 B2 * 3/2009 Guarino et al. ..... 347/19
8,632,145 B2 * 1/2014 Madigan et al. ..... 347/6

FOREIGN PATENT DOCUMENTS

JP 08-282072 10/1996

* cited by examiner

*Primary Examiner* — Lamson Nguyen
(74) *Attorney, Agent, or Firm* — Workman Nydegger

(57) ABSTRACT

Provided is a liquid discharging apparatus that includes a rotating drum which has a medium wound around a part of an outer circumferential surface thereof and transports the medium in a circumferential direction and in which the medium is wound at a first position and a second position in an axial direction of the rotating drum, a transport portion which transports the medium which passes through the first position to the second position on the rotating drum, liquid discharge portions which discharge liquid onto the medium at the first position and the second position, and a position correction unit which corrects the axial position of the medium at the second position by adjusting a transport direction of the medium transported by the transport portion.

8 Claims, 6 Drawing Sheets

LIQUID DISCHARGING APPARATUS

BACKGROUND

1. Technical Field

The present invention relates to a liquid discharging apparatus.

2. Related Art

A printing apparatus which prints an image on a transported medium has been developed. A certain type of the printing apparatus described above performs image forming in a state where a medium is wound around a roller multiple times.

A thermal transfer recording method in which an image is recorded on an image receiving material which is transported in a state where the image receiving material is wound around a platen roller twice in an inclining direction with respect to a multi-ink sheet has been disclosed in JP-A-8-282072.

However, when the printing is performed on a medium which is transported in a state where the medium is wound around the roller multiple times, there is possibility that a position of the medium may be deviated with respect to the roller. In a case where an image is formed in such a manner that the medium passes under heads multiple times, if a position of the medium is deviated on the roller, an image quality is deteriorated. Thus, it is necessary to appropriately adjust a liquid landing position.

SUMMARY

An advantage of some aspects of the invention is to appropriately adjust a liquid landing position.

According to an aspect of the invention, there is provided a liquid discharging apparatus that includes a rotating drum which has a medium wound around a part of an outer circumferential surface thereof and transports the medium in a circumferential direction and in which the medium is wound at a first position and a second position in an axial direction of the rotating drum, a transport portion which transports the medium which passes through the first position to the second position on the rotating drum, liquid discharge portions which discharge liquid onto the medium at the first position and the second position, and a position correction unit which corrects the axial position of the medium at the second position by adjusting a transport direction of the medium transported by the transport portion.

Other aspects of the invention will be made clear by this specification and the accompanying drawings.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
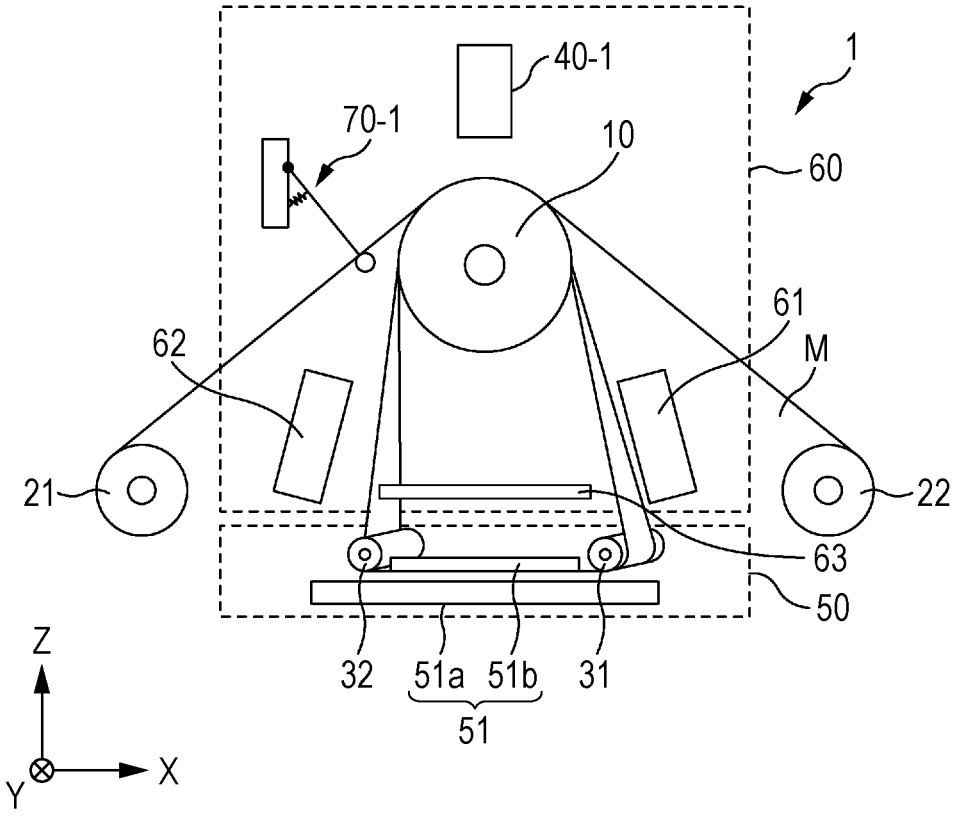
FIG. 1 is a schematic side view of an ink jet printer in an embodiment.

At least the following matters will be clearly understood by this specification and the accompanying drawings. That is, there is provided a liquid discharging apparatus that includes a rotating drum which has a medium wound around a part of an outer circumferential surface thereof and transports the medium in a circumferential direction and in which the medium is wound at a first position and a second position in an axial direction of the rotating drum, a transport portion which transports the medium which passes through the first position to the second position on the rotating drum, liquid discharge portions which discharge liquid onto the medium at the first position and the second position, and a position correction unit which corrects the axial position of the medium at the second position by adjusting a transport direction of the medium transported by the transport portion.

In this case, when the liquid is discharged onto the medium at the first position, and the liquid is then discharged onto the medium, which is wound at the second position on the rotating drum, again, it is possible to correct an axial position of the medium. Thus, it is possible to appropriately adjust a liquid landing position.

In the liquid discharging apparatus, it is preferable that the transport portion include a first roller which changes the transport direction of the medium which passes through the first position to a direction inclined with respect to the circumferential direction, and a second roller which changes the transport direction of the medium which passes through the first roller to a direction in which the medium is directed to the second position on the rotating drum.

In this case, the medium can be wound around one rotating drum multiple times. Furthermore, in this configuration, the axial position of the medium at the second position can be corrected. Thus, it is possible to appropriately adjust the position of the liquid discharged at the first position and the position of the liquid discharged at the second position.

In the liquid discharging apparatus, it is preferable that a frame member which rotatably holds a shaft of the first roller and a shaft of the second roller be provided, and that the position correction unit corrects a position of the medium by causing the frame member to rotate around an axis perpendicular to an axis of the rotating drum.

In this case, angles of the first roller and the second roller relative to the rotating drum can be changed by causing the frame member to rotate around the axis perpendicular to the axis of the rotating drum. Thus, it is possible to correct the position of the medium at the second position.

In the liquid discharging apparatus it is preferable that a heat source which applies heat to the medium that is transported between the first roller and the second roller be provided.

In this case, it is possible to dry the liquid which lands on the medium in the rotating drum.

In the liquid discharging apparatus, it is preferable that the liquid discharge portions include a first liquid discharge portion which discharges a first liquid onto the medium that is transported to the first position, and a second liquid discharge portion which discharges a second liquid onto the medium that is transported to the second position.

In this case, the liquid discharged through the first liquid discharge portion is different from the liquid discharged through the second liquid discharge portion. Thus, various kinds of liquids can repeatedly land onto the medium.

In the liquid discharging apparatus, it is preferable that the medium pass through a path which has the shortest distance in terms of the outer circumferential surface of the rotating drum.

In this case, the medium passes through the path which has the shortest distance in terms of the outer circumferential surface of the rotating drum, and thus the transport direction of the medium can be matched with an outer circumferential direction of the rotating drum. In addition, the medium can be transported without being slipped over the rotating drum, and thus the position of the medium is prevented from being deviated when the rotating drum rotates. Therefore, it is possible to appropriately adjust the liquid landing position.

In the liquid discharging apparatus, it is preferable that a side edge position detection unit be provided to detect a side edge portion of the medium that is fed between each liquid discharge portion and the rotating drum, and that the position correction unit correct the position of the medium, based on a detection result of the side edge position detection unit.

In this case, it is possible to correct the position of the medium, based on the detection result of the side edge position detection unit.

In the liquid discharging apparatus, it is preferable that a tension applying portion be provided to apply tension to the transported medium.

In this case, the transport portion is controlled in such a manner that an appropriate tension is applied to the medium in portions between the rotating drum and the first roller and between the rotating drum and the second roller, and thus it is possible to correct the axial position of the medium.

Embodiment

Figure 2:
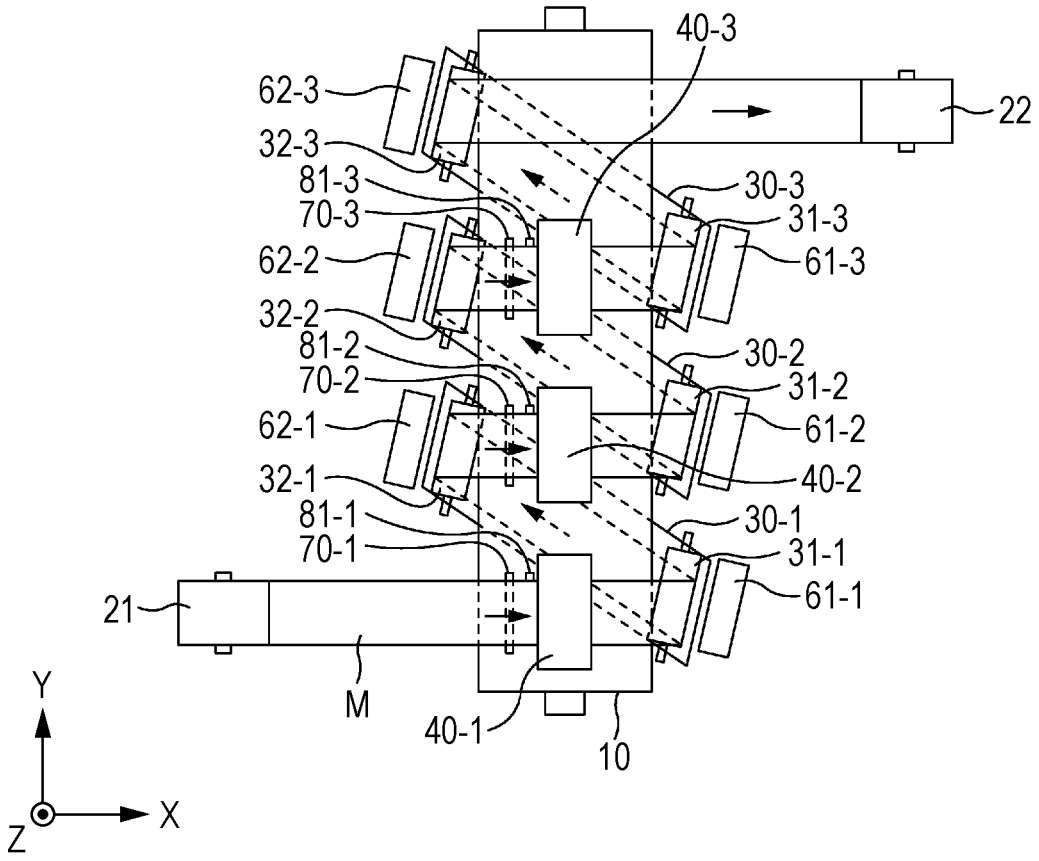
FIG. 2 is a schematic plan view of the ink jet printer in the embodiment.
Figure 3:
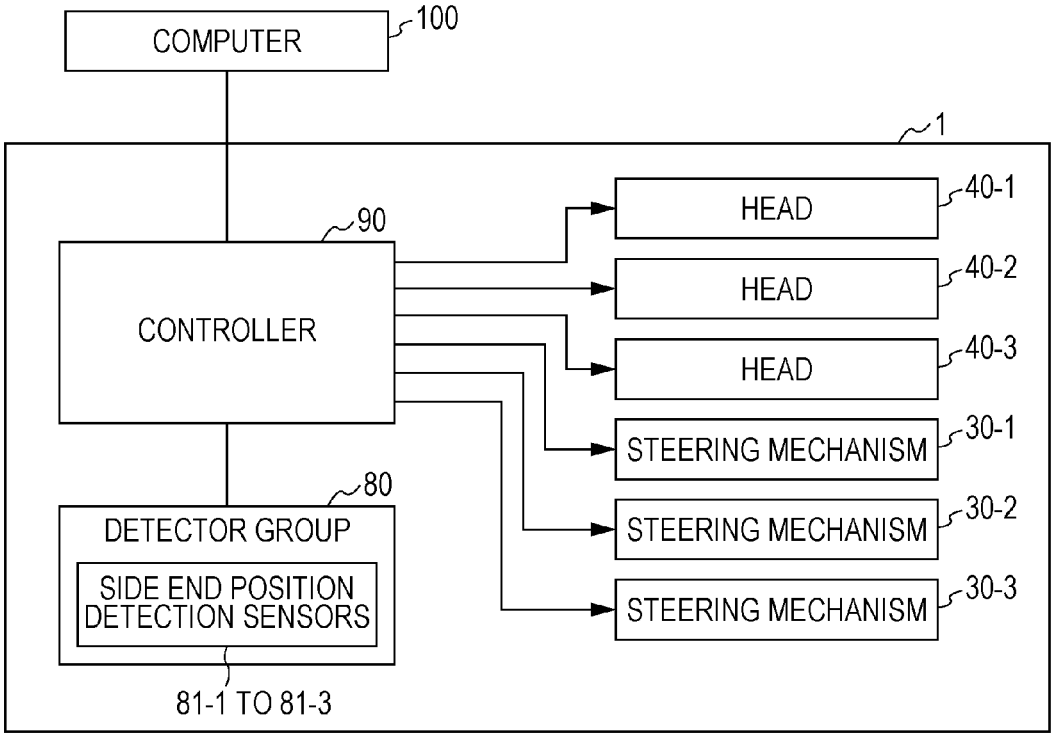
FIG. 3 is a block diagram of the ink jet printer in the embodiment.

FIG. 1 is a schematic side view of an ink jet printer 1 according to the invention. FIG. 2 is a schematic plan view of the ink jet printer 1 according to the invention. FIG. 3 is a block diagram of the ink jet printer 1 according to the invention. Hereinafter, a schematic configuration of the ink jet printer 1 in the embodiment will be described with reference to the accompanying drawings.

For convenience of description, an X axis, a Y axis, and a Z axis are illustrated in FIGS. 1 and 2. The Z-axis direction shows a vertical direction of the ink jet printer 1, and the X axis and the Y axis show a planar direction.

In the accompanying drawings, a reference numeral "1" is given, after the hyphen "-", to each component corresponding to a first printing unit. Similarly, a reference numeral "2" is given, after the hyphen "-", to each component corresponding to a second printing unit and a reference numeral "3" is given, after the hyphen "-", to each component corresponding to a third printing unit. In addition, when the description is common to components, the hyphen "-" and following reference numerals are not given to the components.

The ink jet printer 1 (corresponding to a liquid discharging apparatus) in the embodiment can discharge three kinds of ink, and thus the ink jet printer 1 has three printing units. One printing unit includes a steering mechanism 30 (corresponding to a transport portion), a head 40, a drying device 51, a first cooling device 61, a second cooling device 62, a heat insulator 63, a dancer roll 70, and a side edge position detecting sensor 81. A head 40-1 of a first printing unit corresponds to a first liquid discharge portion and a head 40-2 of a second printing unit corresponds to a second liquid discharge portion. In addition, a portion below the head 40-1 of the first printing unit corresponds to a first position and a portion below the head 40-2 of the second printing unit corresponds to a second position.

Furthermore, the ink jet printer 1 includes a rotating drum 10, a feeding roller 21, a winding roller 22, and a controller 90.

Heads 40-1 to 40-3, steering mechanism 30-1 to 30-3, and a detector group 80 including the side edge position detecting sensor 81 are connected to the controller 90, as illustrated in FIG. 3. In addition, the controller 90 is connected to a computer 100.

The rotating drum 10 of the ink jet printer 1 of the embodiment has a medium M be wound around an outer circumferential surface thereof. When the rotating drum 10 rotates, the medium M is transported. A shaft center direction of the rotating drum 10 is parallel to the Y-axis direction. The rotating drum 10 is a rotating drum extending in the Y-axis direction.

The feeding roller 21 feeds a paper sheet as an example of the medium M to the rotating drum 10. In addition, the winding roller 22 receives the paper sheet on which printing is performed.

The steering mechanism 30 includes a first roller 31 and a second roller 32. Furthermore, a drying device 51 is provided in the steering mechanism 30. The details of the steering mechanism will be described below, with reference to FIGS. 4 and 5.

The head 40 is disposed on an upper portion of the rotating drum 10 and on a below-described course of the medium M. However, the disposition of the head 40 is not limited to the upper portion of the rotating drum 10 as long as the head 40 faces the outer circumferential surface of the rotating drum 10 and can discharge the ink onto the medium M.

The first roller 31 of the steering mechanism 30 is provided below the rotating drum 10 and on a +X-axis direction side. In addition, the second roller 32 of the steering mechanism 30 is provided below the rotating drum 10 and on a −X-axis direction side. A shaft center of the first roller 31 and a shaft center of the second roller 32 are arranged at angles at which each of the shaft centers thereof is not parallel to a shaft center of the rotating drum 10. The second roller 32 is arranged to be shifted further on a +Y-axis side than the first roller 31.

The first roller 31 changes a transport direction of the medium M which is fed from the rotating drum 10 such that the transport direction inclines with respect to the X-axis direction. In this case, the X-axis direction of the transport direction is changed to the −X direction and the Y-axis direction thereof is changed to the +Y direction.

The second roller 32 has the medium M, which is fed from the drying device 51, be wound therearound, and thus the second roller 32 changes the course of the medium M. In this case, the course of the medium M is changed so as to be parallel to an outer circumferential direction of the rotating drum 10. Accordingly, the medium can be wound around one rotating drum 10 multiple times.

The drying device 51 is disposed under the rotating drum 10 and between the first roller 31 and the second roller 32. The drying device 51 dries the ink on the medium M which travels between the first roller 31 and the second roller 32. The drying device 51 is accommodated in the steering mechanism 30 described below.

The heat insulator 63 is disposed between the rotating drum 10 and the drying device 51. In addition, the first cooling device 61 is disposed under a center axis of the rotating drum 10 and above the first roller 31. Further, the first cooling device 61 is disposed further on the +X-axis direction than the rotating drum 10. The first cooling device 61 cools the medium M which travels between the rotating drum 10 and the first roller 31.

Furthermore, the second cooling device 62 is disposed under the center axis of the rotating drum 10 and above the second roller 32. Further, the second cooling device 62 is disposed further on the −X-axis direction than the rotating drum 10. The second cooling device 62 cools the medium M which travels between the rotating drum 10 and the second roller 32.

The dancer roll 70 is a device which applies tension to the medium M. A dancer roll 70-1 of the first printing unit is disposed between the feeding roller 21 and the head 40-1. Meanwhile, each of dancer rolls 70-2 and 70-3 of the second printing unit and the third printing unit is provided between the second roller 32 and the head 40. A configuration of the dancer roll 70 will be described below.

The side edge position detecting sensor 81 is disposed on an upstream side of the head 40 and in a vicinity of a side edge position of the medium M. Therefore, the side edge position detecting sensor 81-1 of the first printing unit detects a position of the side edge of the medium M and sends information on the position of the side edge to the controller 90, and thus the controller 90 can acquire the position of the medium M in the vicinity of the head 40-1. Similarly, the side edge position detecting sensors 81-2 and 81-3 of the second printing unit and the third printing unit detect the positions of the side edge of the medium M, and thus the controller 90 can acquire the positions of the medium M in the vicinities of the heads. Based on the information described above, the controller 90 can control rotation angles of the steering mechanisms 30-1 and 30-2.

The steering mechanism 30 is disposed to incline with respect to the X axis, as illustrated in FIG. 2. A plurality (three in this embodiment) of the steering mechanisms 30 are aligned in the Y-axis direction.

In the ink jet printer 1 configured as above, the medium M fed from the feeding roller 21 is, first, wound around an upper portion of the rotating drum 10 which is located below the head 40-1. Then, the head 40-1 discharges the ink onto the medium M. Next, the medium M is wound around a first roller 31-1. Subsequently, a travel direction of the medium M which is wound around the first roller 31-1 is changed as illustrated in FIG. 2.

Then, the medium M passes through a drying device 51-1. Therefore, the ink that lands on the medium M is dried. Next, the medium M is wound around a second roller 32-1. Subsequently, the travel direction of the medium M which is wound around the second roller 32-1 is changed to be parallel to the X-axis direction.

Then, the medium M passes through the heads 40-2 and 40-3 in such a manner that the medium M is subjected to the similar transporting processes described above. Therefore, printing is performed on the medium M. Three printing units are provided in the embodiment, and thus the printing is performed using three kinds of ink. When the printing is finished, the medium M is wound around the winding roller 22.

Figure 4:
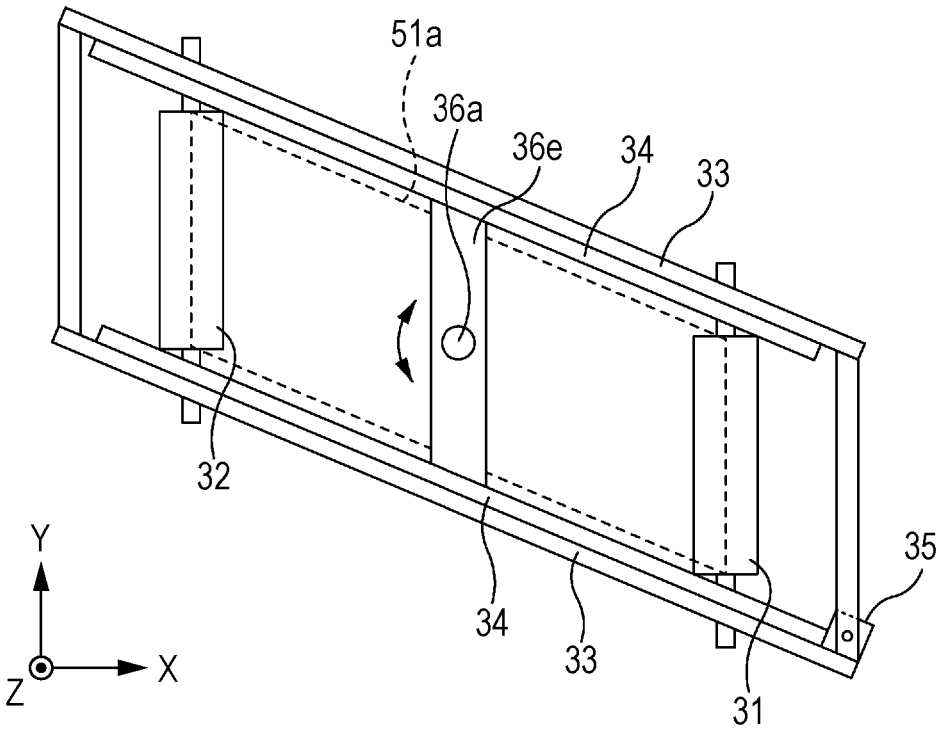
FIG. 4 is a plan view of a steering mechanism.
Figure 5:
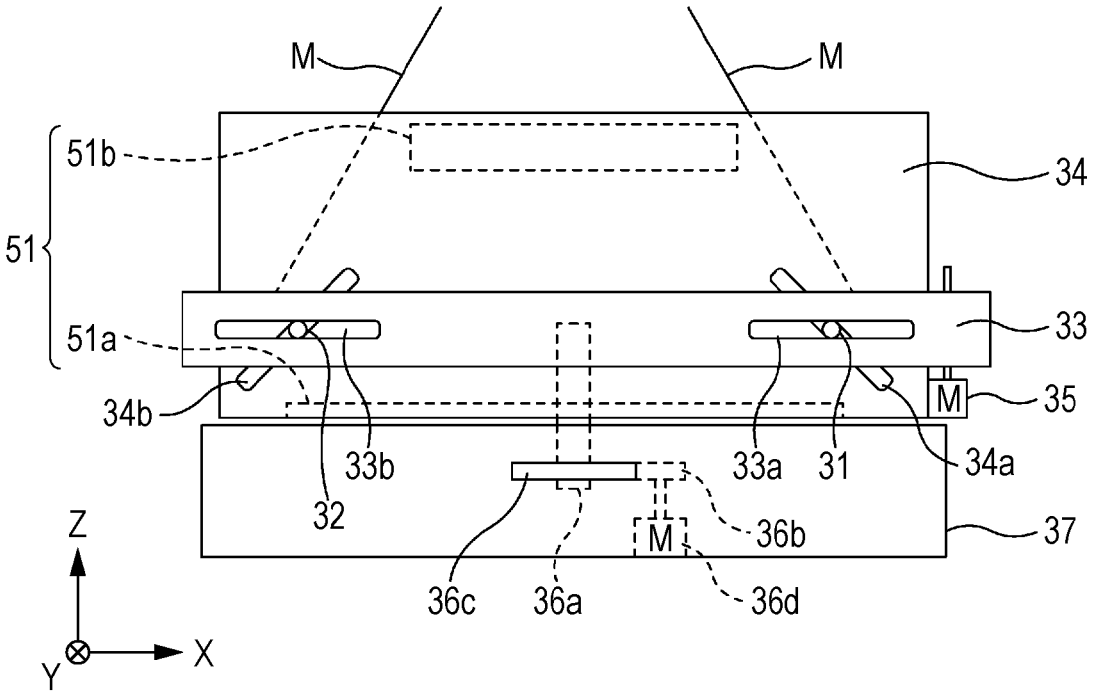
FIG. 5 is a side view of the steering mechanism.

FIG. 4 is a plan view of the steering mechanism 30. FIG. 5 is a side view of the steering mechanism 30. For the convenience of description, an X axis, a Y axis, and a Z axis are illustrated in FIGS. 4 and 5, as similar to the drawings described above.

The steering mechanism 30 includes a first roller 31, a second roller 32, an outer frame 33, and an inner frame 34. Furthermore, the steering mechanism 30 includes a vertical movement motor 35, a rotating mechanism 36 (corresponds to a position correction unit), and a base 37. In addition, a drying device 51 is provided in the steering mechanism 30.

The outer frame 33 and the inner frame 34 constitute a frame (corresponding to a frame member) which rotatably holds the first roller 31 and the second roller 32. The outer frame 33 and the inner frame 34 to which the first roller 31 and the second roller 32 are attached correspond to a transport portion.

In the plan view illustrated in FIG. 4, the outer frame 33 is disposed to surround a periphery of the inner frame 34. The outer frame 33 includes an outer slide hole 33*a* which holds a shaft of the first roller 31, and an outer slide hole 33*b* which holds a shaft of the second roller 32, as illustrated in FIG. 5. The outer slide holes 33*a* and 33*b* are slide holes extending in a longitudinal direction of the frame.

The inner frame 34 includes an inner slide hole 34*a* which holds a shaft of the first roller 31, an inner slide hole 34*b* which holds a shaft of the second roller 32. The inner slide holes 34*a* and 34*b* are slide holes which extend, in the longitudinal direction, from an outside lower portion to an inside upper portion of the frame.

Furthermore, a vertical movement motor 35 is fixed to an end portion of the inner frame 34. An output shaft of the vertical movement motor 35 and the outer frame 33 are connected via a ball screw spline mechanism which converts a rotational movement of the vertical movement motor 35 to a vertical movement. When the controller 90 causes the vertical movement motor 35 to rotate, a position of the outer frame 33 is displaced in a vertical direction.

When the outer frame 33 moves upward, the first roller 31 passing through the outer slide hole 33*a* moves upward. However, the movement direction thereof is regulated by the inner slide hole 34*a*, the first roller 31 moves upward and moves toward the inside of the inner frame 34. Similarly, when the outer frame 33 moves upward, the second roller 32 passing through the outer slide hole 33*b* moves upward. However, the movement direction thereof is regulated by the inner slide hole 34*b*, the second roller 32 moves upward and moves toward the inside of the inner frame 34.

The steering mechanism 30 includes the rotating mechanism 36 which causes the outer frame 33 and the inner frame 34 to rotate around the Z axis. The rotating mechanism 36 includes a rotating shaft 36*a*, a primary gear 36*b*, a secondary gear 36*c*, a rotation motor 36*d*, and a beam member 36*e*. A part of the rotating shaft 36*a*, the primary gear 36*b*, the secondary gear 36*c* and the motor 36*d* are accommodated in the base 37.

The beam member 36*e* is fixed to the frames in which the inner slide holes 34*a* and 34*b* are formed so as to be suspended across the frames. One end of the rotating shaft 36*a* is fixed to the center of the beam member 36*e*. The secondary gear 36*c* is coaxially fixed to the other end of the rotating shaft 36*a*. Meanwhile, the motor 36 is fixed to a base 37 and the primary gear 36*b* is coaxially fixed to the output shaft of the motor 36*d*. The primary gear 36*b* and the secondary gear 36*c* are engaged with each other, and thus torque of the motor 36*d* is transmitted to the rotating shaft 36*a*. Therefore, the inner frame 34 rotates in the Z-axis direction. The controller 90 controls the rotation of the motor 36*d*. The controller 90 can control the angles of the first roller 31 and the second roller 32 by controlling the rotation angles of the motor 36*d*.

The drying device 51 is provided in the inner frame 34. The hot air blowing unit 51*a* (corresponding to a heat source) is provided below the inner frame 34. The hot air blowing unit 51*a* blows hot air to the medium M which passes over the hot air blowing unit 51*a*, and thus drying of the ink is encouraged. In addition, a hot air receiving unit 51*b* is provided above the inner frame 34. The heat from the hot air blowing unit 51*a* or the like is drawn out through the hot air receiving unit 51*b*.

Figure 6:
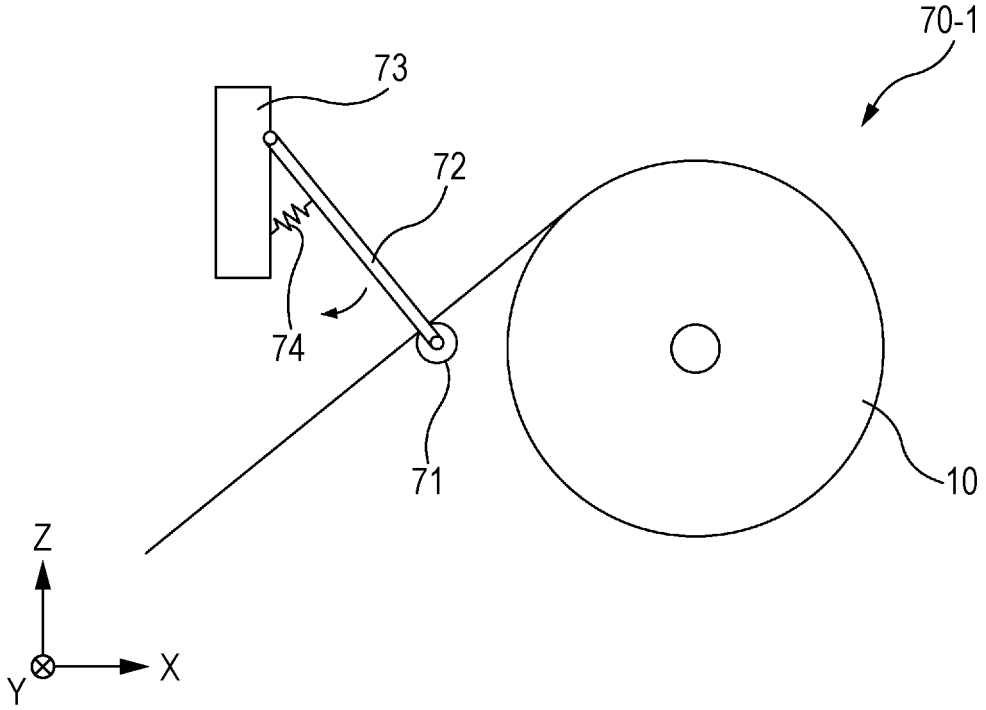
FIG. 6 is an explanatory view of a dancer roll.

FIG. 6 is an explanatory view of a dancer roll 70. The dancer roll 70 (corresponding to a tension applying portion) is a device applying tension to the medium M. The dancer roll 70 includes a driven roller 71, a holding bar 72, a fixing wall 73, and a spring 74.

The driven roller 71 is held in one end of the holding bar 72 in a state where the driven roller 71 is rotatable around the Y axis. It is preferable that the holding bars 72 be provided at both ends of a rotating shaft of the driven roller 71. The other ends of the holding bars 72 are attached to the fixing wall in a state where the holding bars 72 are rotatable around the Y axis. The fixing wall 73 may be, for example, a frame in the ink jet printer 1. One end of the spring 74 is fixed to the holding bar 72. In addition, the other end of the spring 74 is fixed to the fixing wall 73. Thus, a force is applied to the holding bar 72 so as to pull the holding bar 72 toward the fixing wall 73 side. The driven roller 71 is put on a back surface side of the medium M.

The ink jet printer 1 is configured as above, and thus a force which pulls the medium M to the fixing wall 73 side is applied to the medium M in a state where the driven roller 71 is put on the back surface side of the medium M. As a result, tension is generated between the dancer roll 70 and the rotating drum 10. Thus, even when an approach angle of the medium is slightly changed by the steering mechanism 30, the transport direction of the medium M can be appropriately corrected on the rotating drum 10 such that the transport direction of the medium M is parallel to the outer circumferential direction of the rotating drum 10.

In the ink jet printer 1 described above, the controller 90 causes the side edge position detection sensor 81-2 to detect a side edge of the medium M. From detection results, if it is necessary to move the medium M closer to the +Y axis direction, the controller 90 causes the steering mechanism 30-1 to slightly rotate clockwise about the Z axis. On the contrary, if it is necessary to move the medium M closer to the −Y axis direction, the controller 90 causes the steering mechanism 30-1 to slightly rotate counterclockwise about the Z axis. Accordingly, it is possible to correct a position of medium M based on the detection results from the side edge position detection sensor 81. Therefore, a position of an image formed by the head 40-1 can be appropriately matched with a position of an image formed by the head 40-2.

Figure 7:
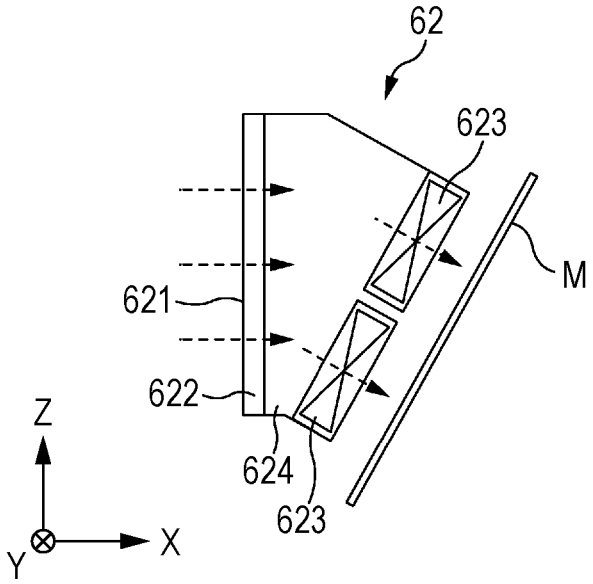
FIG. 7 is an explanatory view of a second cooling device.

FIG. 7 is an explanatory view of the second cooling device 62. The first cooling device 61 described above has the same configuration as the second cooling device 62. Thus, the second cooling device 62 will be described as an example. The second cooling device 62 includes a duct 624, and a filter 622 and a cooling fan 623 in the duct 624. An arrow illustrated by a dashed line in FIG. 7 shows a path of air.

The filter 622 is attached to an outside air intake port 621 which is located on one end side of the duct 624. A plurality of the cooling fans 623 are installed on the other end side of the duct 624. The cooling fan 623 is installed in a direction where the cooling fan 623 can blow air to the medium M, and thus the air taken in from the outside air intake port 621 is blown to the medium M. Accordingly, the air cools down a temperature of the medium M which is warmed by the drying device 51 described above.

According to the ink jet printer 1 configured as above, when the ink is discharged onto the medium at a position of the head 40-1, and the ink is then discharged onto the medium, which is wound around the rotating drum 10 at a position of the head 40-2, again, it is possible to correct the position of the medium M. Thus, it is possible to appropriately adjust an ink landing position.

According to the configuration described above, it is possible to change angles of the first roller 31 and the second roller 32 relative to the rotating drum 10 by causing the steering mechanism 30 to rotate around the Z axis which is perpendicular to an axis of the rotating drum 10. Thus, it is possible to correct the position of the medium M at the position of the head 40-2.

Furthermore, tension is applied to the medium M by the dancer roll 70, and thus the medium M can be fed to be approximately parallel to an outer circumferential direction of the rotating drum 10. Therefore, the medium M passes through a path which has the shortest distance in terms of the outer circumferential surface of the rotating drum 10. In addition, the medium M can be transported without being slipped over the rotating drum 10 (in other words, a peripheral speed of the rotating drum 10 is matched with a transport speed of the medium M), and thus the position of the medium M is prevented from being deviated in an axial direction of the rotating drum 10 when the rotating drum 10 rotates. Therefore, it is possible to appropriately adjust the ink landing position.

Other Embodiments

In the embodiment described above, the ink jet printer 1 is described as a liquid discharging apparatus. However, without being limited thereto, the liquid discharging apparatus can be embodied in a liquid discharging apparatus which ejects or discharges fluid (liquid, liquid material in which particles of a functional material are dispersed, fluid material such as a gel) other than ink. A piece of technology similar to the embodiment described above may be applied to various types of devices using an ink jet technology, such as a color filter manufacturing device, a dyeing device, a fine processing device, a semiconductor manufacturing device, a surface processing device, a three-dimensional molding machine, a gas vaporizer device, an organic EL manufacturing device (particularly, a macromolecular EL manufacturing device), a display manufacturing device, a film forming device, and a DNA chip manufacturing device. Also, these methods or manufacturing method are within the scope of application.

Head

In the embodiment described above, the ink can be discharged using a piezoelectric element. However, a liquid discharging method is not limited thereto. Other methods, for example, a method in which bubbles are generated in nozzles by applying heat may be applied.

The embodiments described above are intended to facilitate the understanding of the invention, and are not intended to be construed as limiting the invention. The invention can be changed or modified insofar as it is within the scope thereof. Needless to say, the invention includes equivalents thereof.

The entire disclosure of Japanese Patent Application No. 2013-065801, filed Mar. 27, 2013 is expressly incorporated by reference herein.

What is claimed is:

1. A liquid discharging apparatus comprising:

a rotating drum which has a medium wound around a part of an outer circumferential surface thereof and transports the medium in a circumferential direction and in which the medium is wound at a first position and a second position in an axial direction of the rotating drum;

a transport portion which transports the medium which passes through the first position to the second position on the rotating drum;

liquid discharge portions which discharge liquid onto the medium at the first position and the second position; and a position correction unit which corrects the axial position of the medium at the second position by adjusting a transport direction of the medium transported by the transport portion.

2. The liquid discharging apparatus according to claim 1, wherein the transport portion includes a first roller which changes the transport direction of the medium which passes through the first position to a direction inclined with respect to the circumferential direction, and a second roller which changes the transport direction of the medium which passes through the first roller to a direction in which the medium is directed to the second position on the rotating drum.

3. The liquid discharging apparatus according to claim 2, further comprising:

a frame member which rotatably holds a shaft of the first roller and a shaft of the second roller, wherein the position correction unit corrects a position of the medium by causing the frame member to rotate around an axis perpendicular to an axis of the rotating drum.

4. The liquid discharging apparatus according to claim 2, further comprising:

a heat source which applies heat to the medium that is transported between the first roller and the second roller.

5. The liquid discharging apparatus according to claim 1, wherein the liquid discharge portions include a first liquid discharge portion which discharges a first liquid onto the medium that is transported to the first position, and a second liquid discharge portion which discharges a second liquid onto the medium that is transported to the second position.

6. The liquid discharging apparatus according to claim 1, wherein the medium passes through a path which has the shortest distance in terms of the outer circumferential surface of the rotating drum.

7. The liquid discharging apparatus according to claim 1, further comprising;

a side edge position detection unit which detects a side edge portion of the medium that is fed between each liquid discharge portion and the rotating drum, wherein the position correction unit corrects the position of the medium, based on a detection result of the side edge position detection unit.

8. The liquid discharging apparatus according to claim 1, further comprising:

a tension applying portion which applies tension to the transported medium.

* * * * *